United States Patent [19]

Hayashi et al.

[11] Patent Number: 5,017,455

[45] Date of Patent: May 21, 1991

[54] PROCESS FOR RECOVERING SUPPORT FROM PHOTOGRAPHIC FILM

[75] Inventors: Goichi Hayashi; Sajuro Fujimagari; Kensaku Nakamura; Ryuichi Ishida, all of Kanagawa, Japan

[73] Assignees: Fuji Photo Film Co.; Panac-Industries Inc., Kanagawa, both of Japan

[21] Appl. No.: 507,439

[22] Filed: Apr. 11, 1990

[30] Foreign Application Priority Data

Apr. 26, 1989 [JP] Japan ..... 1-106841

[51] Int. Cl.[5] ..... G03C 11/12

[52] U.S. Cl. ..... 430/256; 430/262; 430/329; 430/347; 430/432; 430/531; 430/539

[58] Field of Search ..... 430/256, 262, 432, 539, 430/329, 531, 347

[56] References Cited

U.S. PATENT DOCUMENTS

| | | | |
|---|---|---|---|
| 2,850,411 | 9/1958 | Bratring | 430/531 |
| 3,291,610 | 12/1966 | Abbott et al. | 430/262 |
| 3,620,737 | 11/1971 | Etter | 430/302 |

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A process for recovering a support from a photographic film is disclosed. The photographic film comprises the support and an undercoating layer provided thereon. The support is made of cellulose triacetate film base. The undercoating layer contains gelatin and cellulose nitrate. According to the present invention, the process comprises the steps of: (I) treating the photographic film with an aqueous solution of a surfactant; and then (II) treating the photographic film with an aqueous solution of a protease to remove the undercoating layer from the support. The aqueous solution of the protease used at the step of (II) preferably further contains an anionic surfactant. It is also preferred that the process further contains the step of (III) treating the recovered support with an aqueous solution of hydrogen peroxide to bleach the support.

20 Claims, No Drawings

PROCESS FOR RECOVERING SUPPORT FROM PHOTOGRAPHIC FILM

FIELD OF THE INVENTION

The present invention relates to a process for recovering a support from a photographic film. In more detail, the invention relates to a process for recovering a support made of cellulose triacetate film base from a photographic film which comprises the support and an undercoating layer containing gelatin and cellulose nitrate provided thereon to recycle the support.

BACKGROUND OF THE INVENTION

In general, a light-sensitive (photographic) material comprises a support made of a plastic film base and various layers provided thereon. The layers include an undercoating layer, a backing layer and photographic layers such as a light-sensitive layer, an intermediate layer and a protective layer.

In the present specification, not only the light-sensitive material having the photographic layers but also the so-called "photographic base" (i.e., a support having an undercoating layer) are referred to as the term "photographic film".

The support of the photographic film is generally made of cellulose triacetate film base. The film base is usually prepared by a fluid film forming method (cf., Japanese Patent Publication No. 45(1970)-9074). The method comprises the steps of dissolving cellulose acetate which contains bound acetic acid in an amount of 60 to 62% together with a plasticizer in a solvent such as a mixture of methylene chloride and methyl alcohol to form dope; filtrating and defoaming the formed dope; spreading the dope on a continuously moving support such as a metallic drum and an endless band; and evaporating the solvent.

An undercoating layer can be provided on the surface of the support. The undercoating layer has a function of increasing the adhesion force between the support and photographic layers such as a light-sensitive layer. The undecorating layer may also be provided between the support and a backing layer. The backing layer functions as an antistatic backing, an anticurl backing, a matt backing and an antihalation backing.

The undercoating and backing layers can be prepared by coating a solution of the components of the layers on the surface of a support. The solvent of the solution is preferably so selected that the support swells in the solvent or is partially dissolved in the solvent. If such a solvent is used, the coated components penetrate into the support, and the layers tightly bind the support because the components function as an anchor.

By the way, the recycling recently is of global importance for the saving of natural resources and the protection of environment. The support of the photographic film is not changed through exposure and development. Therefore, the support can be recycled by recovering it from the used photographic film and reusing it as a raw material of a new photographic film.

A few processes for recovering a support from a photographic film have been known.

Prior to the recovering process, the photographic films are collected from the manufacturer, processor and various users of the film. For example, the waste from a film factory contains photographic films which are residual products produced before or after the process of coating photographic layers on a support. Further, a hospital, a motion picture company, a broadcasting station and a processing laboratory dump used photographic films in bulk. The collected films are cut into tips one to several centimeters square for the recovering process.

One of the known processes comprises the steps of important the tips of the film in an aqueous solution containing a protease to remove gelatin layers such as photographic layers (e.g., a light-sensitive layer) and an undecorating layer from the support, washing the tips with water, and optionally extracting and removing dyes from the tips by using a solvent such as a mixture of acetone and methanol, if the tips are colored. The tips are then washed again with water and dryed. The reproduced tips are used for the preparation of a support of a photographic film or the other materials.

Another known process is described in Japanese Patent Provisional Publication No. 53(1978) 15829, which relates to an improvement of a process for recovering a support made of cellulose triacetate film base from a photographic film which comprises the support and a backing layer and/or an undercoating layer containing a synthetic polymer compound having a molecular weight of not less than 5,000 provided thereon. The improvement is that the film is pretreated with an organic solution containing at least one organic solvent in which the cellulose triacetate film base is dissolved or swells or with a solution of an inorganic acid. This process is effective in recovering a support from a photographic film which comprises the support and a backing layer and/or an undercoating layer containing a synthetic polymer compound, which is used for highly improving the quality of the photographic film.

SUMMARY OF THE INVENTION

The present inventors have studied the known processes described above, and note some problems.

So far cellulose nitrate (nitrocellulose, NC) has been added to an undercoating layer containing gelatin to tightly bind the layer to the surface of a support made of cellulose triacetate film base. According to study of the present inventors, it is difficult for the above-described known processes to completely remove cellulose nitrate from the support. Therefore, the known processes hardly recover high quality tips of cellulose triacetate film base.

The quality of the reproduced cellulose triacetate tips can be examined. For example, the tips are dissolved in a mixture of methylene chloride and methanol (9:1) to obtain dope, and the transmittance of the dope and the presence of insoluble matters are optically evaluated. If cellulose nitrate is contained in the reproduced tips, the transmittance of the dope is decreased and the amount of the insoluble matters are increased. The reproduced tips containing cellulose nitrate cannot be reused, since they cause some problems. In more detail, there is much trouble in preparation of a new photographic support form the tips containing cellulose nitrate, and the quality of the prepared support is low.

Therefore, cellulose nitrate should be extracted from the low quality reproduced tips described above by using a solvent such as a mixture of acetone and methanol to reuse the tips. However, the solvent for extraction is in danger of explosion. Further, the repetition of the process for extraction and the purification of the solvent by distillation cost a great deal. For the reasons mentioned above, the low quality reproduced tips containing cellulose nitrate are usually destroyed by fire in practice.

An object of the present invention is to provide a process for recovering a support made of cellulose triacetate film base from a photographic film which comprises the support and an undercoating layer containing gelatin and cellulose nitrate provided thereon to obtain high quality reproduced tips of the support which substantially do not contain cellulose nitrate and can be reused for preparation of a new photographic support.

Another object of the invention is to provide an improved process for recovering a support from a photographic film characterized in easy, safe and inexpensive treatments.

There is provided by the present invention a process for recovering a support from a photographic film which comprises the support and an undercoating layer provided thereon, said support being made of cellulose triacetate film base, and said backing layer and/or undercoating layer containing gelatin and cellulose nitrate, wherein the process comprises the steps of:

(I) treating the photographic film with an aqueous solution of a surfactant; and then (II) treating the photographic film with an aqueous solution of a protease to remove the undercoating layer from the support.

DETAILED DESCRIPTION OF THE INVENTION

The photographic film from which a support is recovered according to the present invention comprises a support made of cellulose triacetate film base and an undercoating layer containing gelatin and cellulose nitrate provided thereon. As is described above, the manufacturer, processor and various users dump the photographic film in bulk.

Cellulose nitrate in the backing layer and the undercoating layer is a well known compound which contains nitrogen in an amount of 10 to 14%. Cellulose nitrate is usually contained in the undercoating layer in an amount of about 0.01 to 2.0 g/m$^2$.

Further, gelatin is usually contained in the undercoating layer in an amount of about 0.01 to 2.0 g/m$^2$.

Prior to the step (I) of the present invention, the collected photographic films are preferably cut into tips one to several centimeters square, more preferably one to four centimeters square.

At the step (I) of the present invention, the photographic film (preferably tips of the film) is pre-treated with an aqueous solution of a surfactant.

There is no limitation with respect to the surfactant. Namely, any of a nonionic surfactant, a cationic surfactant and an anionic surfactant is available. A nonionic surfactant is most preferred. A preferred example of the nonionic surfactant is a polyethylene glycol ether such as a polyethylene glycol ether of a higher alcohol, an alkylphenol or a sorbitan ester. Examples of the cationic surfactant include primary, secondary or tertiary amines and a quaternary ammonium. Examples of the anionic surfactant are the same as the examples of the anionic surfactant described below which can be contained in the aqueous solution of the protease used at the step of (II). The surfactant used at the step of (I) is usually contained in the aqueous solution in an amount of 0.1 to 5 weight %.

The aqueous solution of the surfactant used at the step of (I) preferably is an alkaline solution. Alkali is preferably added to the solution. Examples of alkali include sodium carbonate, potassium carbonate, potassium hydrogencarbonate and sodium hydroxide. The amount of alkali depends on the nature of the used surfactant and the composition of the treated photographic film. In general, alkali is preferably used in such an amount that the aqueous solution of the surfactant used at the step of (I) has a pH value of not lower than 8. The aqueous solution of the surfactant more preferably is an alkaline solution having a pH value in the range of 8 to 12.

The photographic film is pre-treated at the step of (I) preferably at a temperature in the range of room temperature to 70° C., and more preferably 30° to 60° C. Further, the photographic film is treated at the step of (I) preferably for 10 to 100 minutes so that the layers of the photographic film such as a light-sensitive layer, an intermediate layer, an undercoating layer and a backing layer swell or soften. The pre-treatment at the step of (I) is preferably conducted while stirring.

The photographic film is preferably washed with water to remove the aqueous solution of the surfactant between the steps of (I) and (II). The photographic film is washed with water usually for 1 to 30 minutes.

At the step (II) of the present invention, the photographic film pre-treated at the step (I) is treated with an aqueous solution of a protease to remove the undercoating layer together with the other layers such as the light-sensitive layer from the support.

The protease used at the step (II) must have a function of digesting gelatin. However, most of the known proteases have such a function. Therefore, there is practically no limitation with respect to the protease. Any of an animal protease, a plant protease and a microbial protease is available. Examples of the animal protease include pepsin, trypsin and chymotrypsin. Examples of the plant protease include papain, chymopapain, bromelain and ficin. A example of the microbial protease is a protease produced by actiomycetes such as pronase (tradename of a protease produced by *Streptomyces griseus*). The pH value of the aqueous solution of the protease used at the step (II) is preferably adjusted to the optimum pH of the protease. The protease used at the step of (II) is usually contained in the aqueous solution in an amount of 0.01 to 2.0 weight %.

The aqueous solution of the protease used at the step of (II) can further contains an anionic surfactant. Examples of the anionic surfactant include a salt of a sulfuric ester of a higher alcohol, a sodium alkylbenzenesulfonate and a salt of a sulfuric ester of a polyoxyethylene adduct. A salt of a sulfuric ester of a higher alcohol is particulalry preferred. The aqueous solution of the protease used at the step of (II) preferably contains the anionic surfactant in an amount of 0.1 to 5 weight %.

The photographic film is treated at the step of (II) preferably at a temperature in the range of room temperature to 70 ° C., and more preferably 30° to 60° C. Further, the photographic film is treated at the step of (II) preferably for 10 to 200 minutes so that the undercoating layer containing cellulose nitrate are removed together with the other layers such as the light-sensitive layer from the photographic film. The treatment at the step of (II) is preferably conducted while stirring.

The photographic film is preferably washed with water to remove the aqueous solution of the protease after the step of (II). The photographic film is washed with water usually for 1 to 30 minutes.

In the case that a colored support is removed from a photographic film according to the present invention, the support recovered at the step (II) is preferably post-treated with an aqueous solution of hydrogen peroxide to bleach the support at the step (III).

Hydrogen peroxide used at the step of (III) is preferably contained in the aqueous solution in an amount of 1 to 20 weight %. The conditions at the bleaching step of (III) depend on the concentration of hydrogen peroxide and the degree of the color of the support. The recovered support is post-treated at the step of (III) preferably at a temperature in the range of room temperature to 90° C., and more preferably 70° to 90° C. Further, the support is treated at the step of (III) preferably for 30 to 150 minutes so that the support is bleached. The post-treatment at the step of (III) is preferably conducted while stirring.

The recovered support is preferably washed with water usually for 1 to 30 minutes after the step of (III).

The tips of the cellulose triacetate support recovered according to the present invention is dissolved in a solvent to obtain dope. The transmittance of the dope obtained according to the present invention is high, and the dope substantially does not contain any insoluble matter. Therefore, the cellulose triacetate dope can be reused for preparation of a support of a new photographic support in analogy with new cellulose triacetate.

The present invention is further described by the following examples.

EXAMPLE 1

A used color positive film (in which the undercoating layer of the film has thickness of 1 μm, and contains cellulose nitrate and gelatin) was cut into tips about 3 centimeter square. Then, 1,300 g of the tips are treated in the following manner.

The cellulose nitrate contained in the undercoating layer was confirmed by using an indicator wherein 3.7 g of diphenylamine

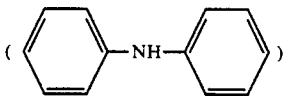

is dissolved in 700 ml of concentrated sulfuric acid and 200 ml of water. In more detail, when the indicator is dropwise added to the films or tips using a glass bar, the films or tips were colored blue, which indicated the presence of cellulose nitrate.

The gelatin contained in the undercoating layer was confirmed by using another indicator wherein 0.5 g of a basic dye having the following formula (C.I. Basic Violet 3) is dissolved in 1,000 ml of water. In more detail, when the films or tips were immersed in the indicator for 5 minutes and washed with water, the films or tips were colored purple, which indicated the presence of gelatin.

(C. I. Basic Violet 3)

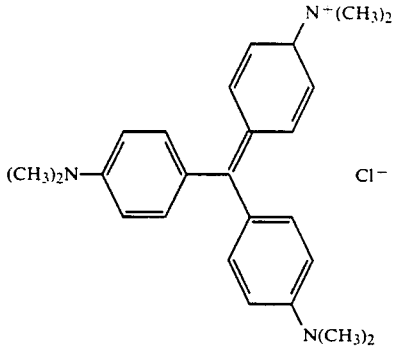

Step I

In 3,000 ml of water were dissolved 30 g of a polyethylene glycol ether of a higher alcohol (Emulgen, tradename of Kao Co., Ltd.) as a nonionic surfactant and 20 g of sodium carbonate to prepare a treatment solution.

The above-obtained tips were immersed in the treatment solution, and pre-treated at 45° C. for 45 minutes while stirring.

The pre-treated tips were immersed in and washed with water at 20° to 25° C. for 20 minutes while stirring.

Step (II)

In 3,000 ml of water were dissolved 2 g of protease (Pronase E, produced by Kaken Chemical Co., Ltd.) and 20 g of a sodium salt of a sulfuric ester of a higher alcohol (mainly containing $C_{12}H_{25}$) as an anionic surfactant (Monogen, tradename of Dai-Ichi Kogyo Seiyaku Co., Ltd.) to prepare a treatment solution.

The tips pre-treated at the step (I) were immersed in the treatment solution, and treated at 55° C. for 40 minutes while stirring.

The treated tips were immersed in and washed with water at 20° to 25° C. for 20 minutes while stirring.

Step (III), Bleaching treatment

With 3,000 ml of water was mixed 300 ml of 35 % aqueous solution of hydrogen peroxide to prepare a bleaching solution.

The tips treated at the step (II) were immersed in the bleaching solution, and post-treated at 80° C. for 90 minutes while stirring.

The post-treated tips were immersed in and washed with water at 20° to 25° C. for 30 minutes while stirring.

The washed tips were dried at 80° C. for 60 minutes to obtain recovered tips.

Evaluation of tips

The recovered tips were dissolved in mixture of methylene chloride and methanol (9:1) to obtain 15% dope. The transmittance of the dope was measured using a photoelectric colorimeter (produced by Kotaki Mfg. Co., Ltd.). Further, the dope was observed with naked eyes to examine the presence of insoluble matter. The results are set forth in Table 1.

EXAMPLE 2

The tips were recovered in the same manner as in the Example 1, except that the anionic surfactant was not used at the step (II), and the treatment time at the step (II) was changed from 40 minutes to 120 minutes.

The recovered tips were evaluated in the same manner as in the Example 1. Thus the transmittance of the dope was measured, the dope was observed with naked eyes to examine the presence of insoluble matter. The results are set forth in Table 1.

COMPARISON EXAMPLE 1

In 3,000 ml of water was dissolved 2 g of protease (Pronase E, produced by Kaken Chemical Co., Ltd.) to prepare a treatment solution.

In the treatment solution, 1,300 g of the tips used in the Example 1 were immersed, and treated at 55° C. for 1 hour while stirring.

The treated tips were immersed in and washed with water at 20° to 25 ° C. for 20 minutes while stirring, and dried.

From the obtained tips, a dye was extracted for 30 minutes using mixture of methanol and acetone (7/3) as a solvent in Soxhlet's extractor.

The tips were immersed in and washed with water at 20 to 25° C. for 10 minutes while stirring, and dried.

The recovered tips were evaluated in the same manner as in the Example 1. Thus the transmittance of the dope was measured, the dope was observed with naked eyes to examine the presence of insoluble matter. The results are set forth in Table 1.

COMPARISON EXAMPLE 2

In 3,000 ml of mixture of methanol and acetone (7/3), 1,300 g of the tips used in the Example 1 were immersed, and left at about 25° C. for 10 hours.

The tips were washed with 3,000 ml of water for 10 minutes.

The recovered tips were evaluated in the same manner as in the Example 1. Thus the transmittance of the dope was measured, the dope was observed with naked eyes to examine the presence of insoluble matter. The results are set forth in Table 1.

REFERENCE EXAMPLE 1

From the tips recovered in the Comparison Example 1, cellulose nitrate was twice extracted using 3,000 ml of mixture of methanol and acetone (7/3).

The tips were washed with 3,000 ml of water for 10 minutes.

The recovered tips were evaluated in the same manner as in the Example 1. Thus the transmittance of the dope was measured, the dope was observed with naked eyes to examine the presence of insoluble matter. The results are set forth in Table 1.

TABLE 1

| Process | Transmittance | Insoluble Matter |
|---|---|---|
| Example 1 | 85% | Not Observed |
| Example 2 | 78% | Not Observed |
| Comp. Example 1 | 70% | Observed |
| Comp. Example 2 | 60% | Observed |
| Ref. Example 1 | 85% | Not Observed |

It is apparent from the results in Table 1 that the tips recovered according to the Examples form transparent dope in which no insoluble matter is observed. Therefore, the dope can be reused for preparation of a support of a new photographic support in analogy with new cellulose triacetate in the case that the tips are recovered according to the present invention from a photographic film which has an undercoating layer containing cellulose nitrate.

On the other hand, the tips recovered according to the Comparison Examples form white turbid dope in which insoluble matter (gel) is observed. Therefore, the dope cannot be reused for preparation of a support of a new photographic support.

In order to reuse the tips recovered according to the Comparison Examples similarly to the Examples, the extraction procedure using mixture of methanol and acetone as a solvent must be repeated as is shown in the Reference Example 1.

EFFECT OF THE INVENTION

According to the process of the present invention, a support made of cellulose triacetate film base can be recovered from a photographic film which comprises the support and an undercoating layer containing gelatin and cellulose nitrate provided thereon. The high quality reproduced tips of the support substantially do not contain cellulose nitrate and can be reused for preparation of a new photographic support. Further, the process of the present invention comprises easy, safe and inexpensive treatments.

We claim:

1. A process for recovering a support from a photographic film which comprises the support and an undercoating layer provided thereon, said support being made of cellulose triacetate film base, and said undercoating layer containing gelatin and cellulose nitrate, wherein the process comprises the steps of:

(I) treating the photographic film with an aqueous solution of a surfactant; and then (II) treating the photographic film with an aqueous solution of a protease to remove the undercoating layer from the support.

2. The process for recovering a support from a photographic film as claimed in claim 1, wherein the surfactant used at the step of (I) is a nonionic surfactant.

3. The process for recovering a support form photographic film as claimed in claim 1, wherein the surfactant used at the step of (I) is a polyethylene glycol ether.

4. The process for recovering a support from a photographic film as claimed in claim 1. wherein the surfactant used at the step of (I) is contained in the aqueous solution in an amount of 0.1 to 5 weight %.

5. The process for recovering support from a photographic film as claimed in claim 1, wherein the aqueous solution of the surfactant used at the step of (I) is an alkaline solution.

6. The process for recovering a support from a photographic film as claimed in claim 1, wherein the aqueous solution of the surfactant used at the step of (I) is an alkaline solution having a pH value int he range of 8 to 12.

7. The process for recovering a support from a photographic film as claimed in claim 1, wherein the photographic film is treated at the step of (I) at a temperature in the range of room temperature to 70° C.

8. The process for recovering a support from a photographic film as claimed in claim 1, wherein the photographic film is treated at the step of (I) for 10 to 100 minutes.

9. The process for recovering a support from a photographic film as claimed in claim 1, wherein the photographic film is washed with water to remove the aqueous solution of the surfactant between the steps of (I) and (II).

10. The process for recovering a support from a photographic film as claimed in claim 1, wherein the protease used at the step of (II) is contained in the aqueous solution in an amount of 0.01 to 2.0 weight %.

11. The process for recovering a support form a photographic film as claimed in claim 1, wherein the aqueous solution of the protease used at the step of (II) further contains an anionic surfactant.

12. The process for recovering a support from a photographic film as claimed in claim 1, wherein the aqueous solution of the protease used at the step of (II) further contains a salt of a sulfuric ester of a higher alcohol as an anionic surfactant.

13. The process for recovering a support form a photographic film as claimed in claim 1, wherein the aqueous solution of the protease used at the step of (II) further contains an anionic surfactant in an amount of 0.1 to 5 weight %.

14. The process for recovering a support from a photographic film as claimed in claim 1, wherein the photographic film is treated at the step of (II) at a temperature in the range of room temperature to 70° C.

15. The process for recovering a support form a photographic film as claimed in claim 1, wherein the photographic film is treated at the step of (II) for 10 to 200 minutes.

16. The process for recovering a support from a photographic film as claimed in claim 1, wherein the photographic film is washed with water to remove the aqueous solution of the protease after the step of (II).

17. The process for recovering a support from a photographic film as claimed in claim 1, wherein the process further contains the step of (III) treating the recovered support with an aqueous solution of hydrogen peroxide to bleach the support.

18. The process for recovering a support from a photographic film as claimed in claim 17, wherein hydrogen peroxide used at the step of (III) is contained in the aqueous solution in an amount of 1 to 20 weight %.

19. The process for recovering a support from a photographic film as claimed in claim 17, wherein the recovered support is treated at the step of (III) at a temperature in the range of room temperature to 90° C.

20. The process for recovering a support from a photographic film as claimed in claim 17, wherein the recovered support is treated at the step of (III) for 30 to 150 minutes.

* * * * *